US007297096B2

(12) United States Patent
Melchoir et al.

(10) Patent No.: US 7,297,096 B2
(45) Date of Patent: Nov. 20, 2007

(54) METHOD AND APPARATUS FOR MANUFACTURING A RESEALABLE PACKAGE

(75) Inventors: Greg W. Melchoir, Green Bay, WI (US); Greg J. VandenHeuvel, Kaukauna, WI (US); Wesley W. Fietzer, Appleton, WI (US); James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 11/242,188

(22) Filed: Oct. 3, 2005

(65) Prior Publication Data

US 2006/0030473 A1 Feb. 9, 2006

Related U.S. Application Data

(63) Continuation of application No. 10/427,716, filed on Apr. 30, 2003, now abandoned.

(51) Int. Cl.
*B31B 1/90* (2006.01)

(52) U.S. Cl. ..... 493/214; 493/927

(58) Field of Classification Search ..... 493/213, 493/214, 927, 215, 394; 53/412, 133.4, 139.2; 29/408, 409, 410

See application file for complete search history.

(56) References Cited

U.S. PATENT DOCUMENTS 3,426,396 A * 2/1969 Laguerre ..... 24/427
3,532,571 A 10/1970 Ausnit
4,024,010 A 5/1977 Boccia
4,094,729 A 6/1978 Boccia
4,249,982 A 2/1981 Ausnit
4,586,319 A 5/1986 Ausnit
4,589,182 A 5/1986 Imai
4,727,709 A 3/1988 Zieke et al.
4,832,505 A * 5/1989 Ausnit et al. ..... 383/5
4,850,178 A 7/1989 Ausnit
4,945,714 A * 8/1990 Bodolay et al. ..... 53/568
5,063,644 A 11/1991 Herrington et al.
5,067,208 A 11/1991 Herrington, Jr. et al.
5,094,395 A 3/1992 Lambert
5,094,470 A 3/1992 Riedel
5,246,416 A 9/1993 Demura et al.
5,301,394 A 4/1994 Richardson et al.
5,301,395 A 4/1994 Richardson et al.
5,334,127 A 8/1994 Bruno et al.
5,412,924 A 5/1995 Ausnit
5,425,216 A 6/1995 Ausnit
5,442,837 A 8/1995 Morgan
5,664,229 A 9/1997 Bhargava et al.
5,664,406 A * 9/1997 Smith ..... 53/459
5,743,070 A 4/1998 Lerner et al.
5,947,603 A 9/1999 Tilman (Continued)

*Primary Examiner*—Rinaldi I. Rada
*Assistant Examiner*—Paul Durand
(74) *Attorney, Agent, or Firm*—Merchant & Gould P.C.

(57) ABSTRACT

A method of making a resealable package is provided. The method comprises providing a closure mechanism, the closure mechanism comprising first and second closure profiles, the first and second closure profiles constructed and arranged to selectively engage, and wherein the first and second closure profiles are engaged. The method further comprises providing a pair of panels comprising a flexible polymeric material, inserting a wedge between the closure profiles, disengaging the closure profiles; and attaching the closure mechanism to the pair of side panels. Various embodiments of opening devices are also presented.

15 Claims, 17 Drawing Sheets

U.S. PATENT DOCUMENTS

| | | | | |
|---|---|---|---|---|
| 5,983,466 | A | 11/1999 | Petkovsek | |
| 5,987,854 | A | 11/1999 | Killinger et al. | |
| D434,345 | S | 11/2000 | Tomic | |
| 6,199,256 | B1 | 3/2001 | Revnew et al. | |
| 6,217,215 | B1 | 4/2001 | Tomic | |
| 6,282,871 | B1 | 9/2001 | Killinger et al. | |
| 6,293,701 | B1 | 9/2001 | Tomic | |
| 6,293,896 | B1 | 9/2001 | Buchman | |
| 6,308,501 | B1 | 10/2001 | Brinkman | |
| 6,477,820 | B1 | 11/2002 | Dutra et al. | |
| 6,490,846 | B2 * | 12/2002 | Koppe | 53/459 |
| 6,581,358 | B2 | 6/2003 | Buchman | |
| 6,622,353 | B2 * | 9/2003 | Provan et al. | 24/585.12 |

* cited by examiner

METHOD AND APPARATUS FOR MANUFACTURING A RESEALABLE PACKAGE

CROSS REFERENCE TO RELATED APPLICATIONS

This application is a Continuation Application to U.S. Ser. No. 10/427,716, filed on Apr. 30, 2003 now abandoned.

FIELD OF THE INVENTION

The present invention relates generally to a method of making polymer packages, for example, plastic bags. In particular, the present invention relates to a methods and apparatuses relating to closure mechanisms for a resealable bag.

BACKGROUND OF THE INVENTION

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Resealable packages typically utilize a closure mechanism that is positioned along the mouth of the package. The closure mechanism often comprises profile elements or closure profiles that engage one another when pressed together. Typically a slider device used for opening the closure mechanism is attached to the closure mechanism while the closure profiles are disengaged. This facilitates filling of the package with product after the slider is attached. However, attaching the slider to a closure mechanism in an open state results in difficulty in handling and aligning the pair of closure profiles during manufacturing. If the slider device is attached to the closure mechanism while the closure mechanism is closed, the closure mechanism must be opened before the package can be filled. Prior methods of opening the closure mechanism, including manually opening the closure mechanism, have proved to be inefficient from a manufacturing standpoint.

It is therefore desirable to attach the slider device to the closure mechanism while the closure mechanism is in a closed state, and to provide a method and apparatus for automatically opening the closure mechanism after the slider device has been attached. Alternately, the slider device may be attached after the closure mechanism has been opened. Further, the opening methods and apparatus of the present invention can be applied to a closure mechanism without a slider, such as a traditional "press-to-close" zipper.

SUMMARY OF THE INVENTION

In accordance with the present invention, a method of making a resealable package is provided. The method comprises providing a closure mechanism, the closure mechanism comprising first and second closure profiles, the first and second closure profiles constructed and arranged to selectively engage, and wherein the first and second closure profiles are engaged. The method further comprises providing a pair of panels comprising a flexible polymeric material, providing a means to open the closure profiles, such as inserting a wedge between the closure profiles, to disengage the closure profiles; and attaching the closure mechanism to the pair of side panels. The opening of the closure profiles and attachment of the closure mechanism to the side panels may occur substantially simultaneously.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

The various features and benefits of the present invention are apparent in light of the following detailed description and the accompanying drawings, in which.

DETAILED DESCRIPTION OF THE INVENTION

Figure 1:
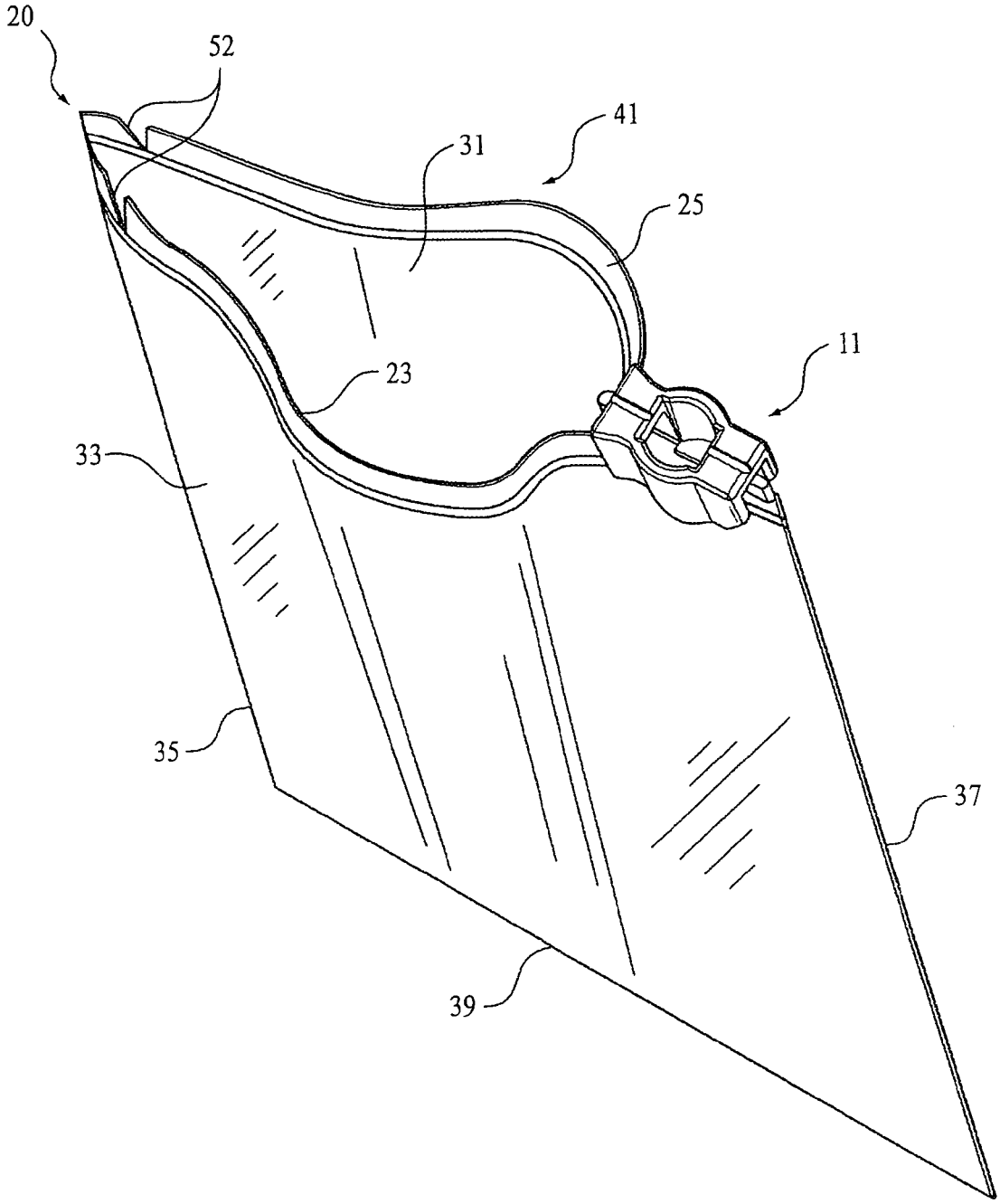
FIG. 1 is a perspective view of a flexible, resealable package manufactured in accordance with an embodiment of the present invention.

FIG. 1 illustrates an example of a resealable, flexible package 20 having a closure mechanism 41 with first and second closure profiles 23, 25 and a slider device 11 to open and close the profiles 23, 25.

The resealable package 20 includes first and second opposed panel sections 31, 33 made from a flexible, polymeric film. For some manufacturing applications, the first and second panel sections 31, 33 are heat-sealed together along two edges 35, 37 and meet at a fold line 39 in order to form a three-edged containment section for a product within the interior of the package 20. The fold line comprises the bottom edge 39. Alternatively, two separate panel sections 31, 33 of polymeric film may be used and heat-sealed together along the two edges 35, 37 and at the bottom 39.

The resealable package 20 also includes a closure mechanism 41 made in accordance with an embodiment of the present invention. The closure mechanism 41 includes first and second closure profiles 23, 25. The first and second closure profiles 23, 25 may be of any appropriate design known in the art. Example closure profiles are disclosed in U.S. Pat. Nos. 5,983,466, 5,947,603, and 6,217,215.

In certain embodiments, a slider device 11 is mounted on the closure mechanism 41 to facilitate the opening and closing of the closure mechanism 41. Slider devices and how they function to open and close such mechanisms, in general, are taught, for example, in U.S. Pat. Nos. 5,063,644, 5,301,394, 5,442,837 and 5,664,229, each of which is incorporated by reference herein, in its entirety. A preferred slider device is taught in U.S. Pat. Nos. 6,293,701 and D434,345 each of which is incorporated by reference herein, in its entirety.

In embodiments that include a slider device, a notch 52 is preferably disposed within the closure mechanism 41. The notch 52 is designed to provide a "park place" into which the slider 11 settles when the closure mechanism 41 is sealed. The notch 52 decreases the chances of an incomplete interlock between the first and second closure profiles 23, 25. Example notches are disclosed, for example, in U.S. Pat. Nos. 5,067,208 and 5,301,395, each of which is incorporated by reference herein, in its entirety.

Figure 2:
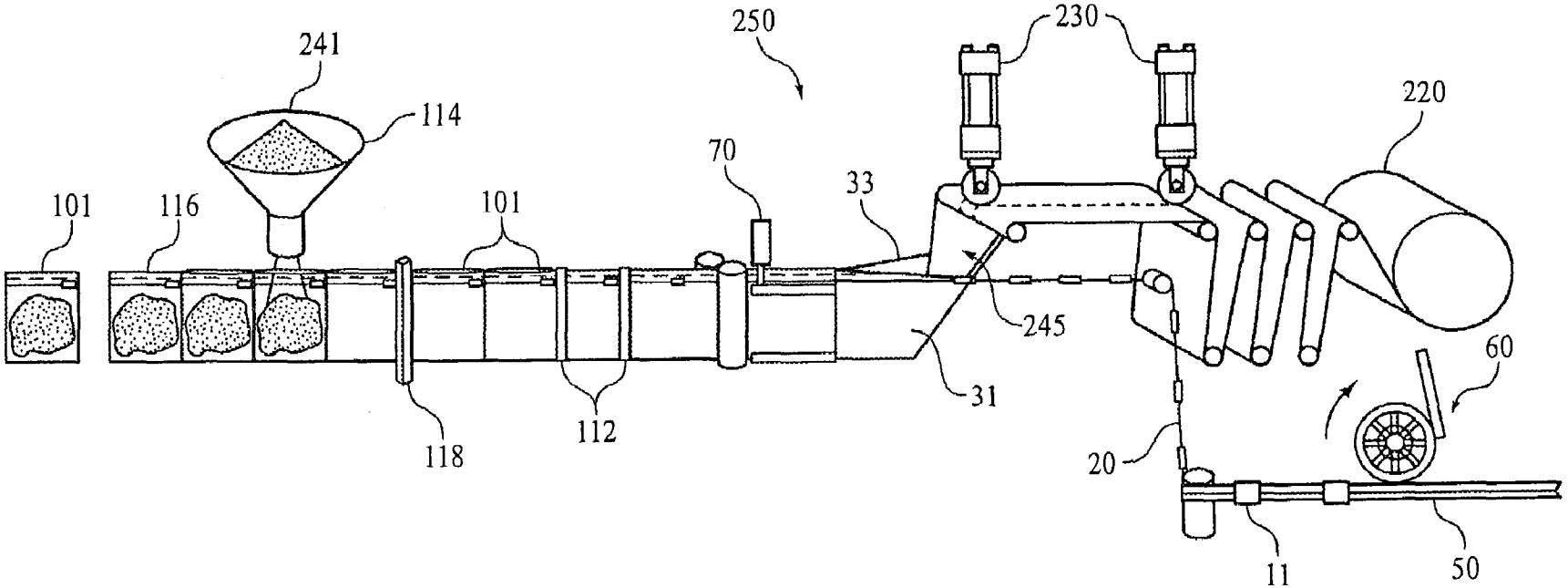
FIG. 2 is a schematic view of a process of manufacturing a resealable package in accordance with an embodiment of the present invention.
Figure 3:
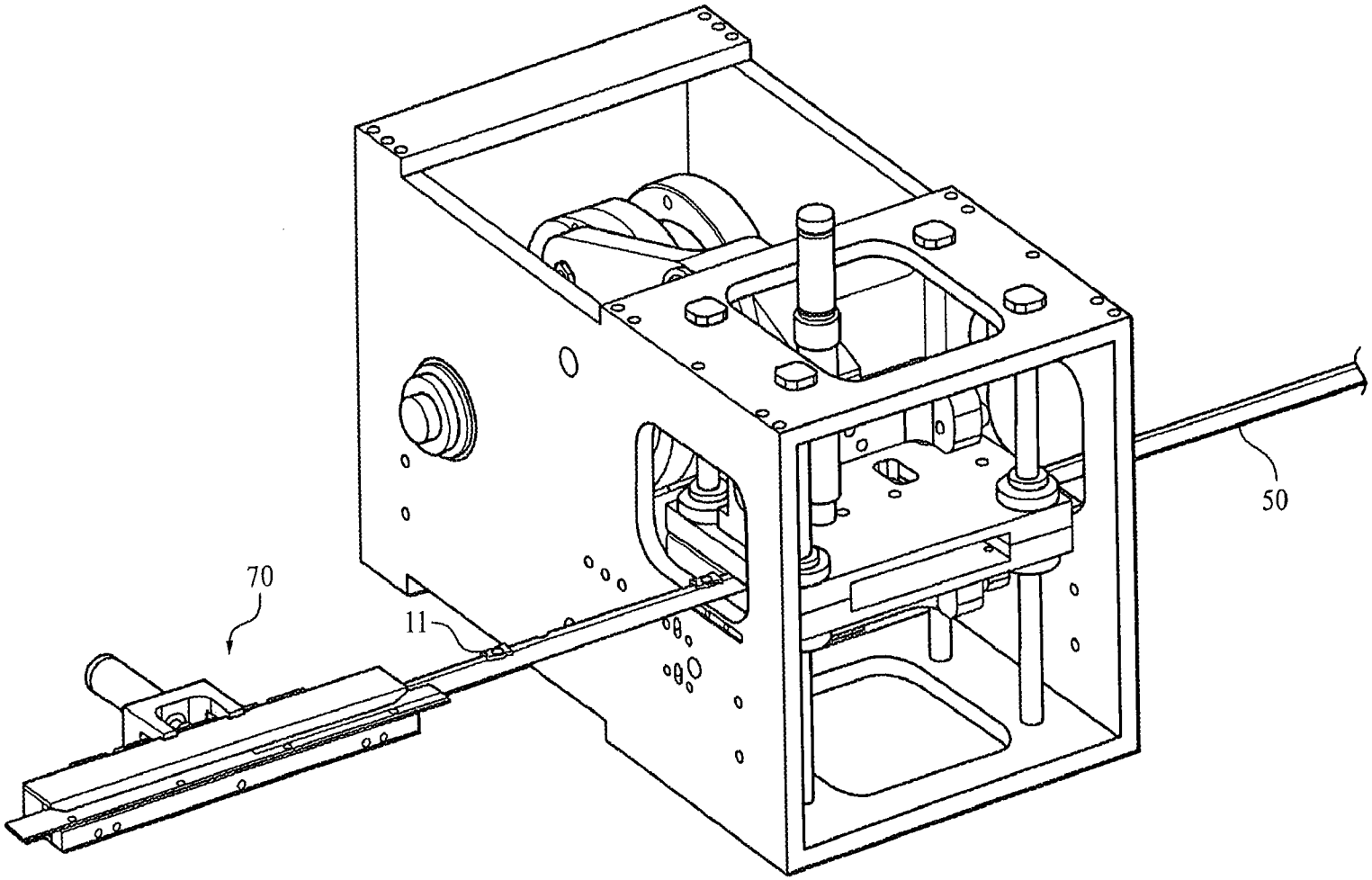
FIG. 3 is a perspective view of a slider attachment device and a device for opening a closure mechanism used in accordance with an embodiment of the present invention.

FIG. 2 illustrates a schematic example of a horizontal form, fill and seal ("HFFS") process for manufacturing a resealable package 20 in accordance with the present invention. The HFFS process described in U.S. Pat. No. 6,293,896, which is incorporated by reference herein, in its entirety, is substantially similar to that described and shown herein with the obvious variation that the package of the present invention is inverted (i.e. the formation and filling in the present invention is from the top) whereas the formation and filling in the '896 patent occurs from the bottom. The first and second closure profiles 23, 25 (not shown individually in FIG. 2) are provided in an engaged configuration as a continuous length of closure profile material 50. Preferably, the closure mechanism material 50 is provided on a roll (not shown). The closure mechanism material 50 is unwound and fed to the HFFS process.

The slider 11 is attached to the closure mechanism material 50 by a slider application station 60. The slider application station 60 applies the slider 11 to the closure mechanism material 50 through the use of any appropriate means known in the art, for example, the apparatuses as described in U.S. Pat. Nos. 6,199,256 and 6,293,896, each of which are hereby incorporated by reference herein, in its entirety. The slider application station 60 may also be used to notch the closure profile material in order to provide the notch 52 (as shown in FIG. 1), as disclosed in U.S. Pat. No. 6,199,256.

After the slider 11 is applied to the closure mechanism material 50, the closure mechanism material 50 passes to the HFFS machine 250. The material that comprises the side panels 31, 33 of resealable package 20 (as shown in FIG. 1) is provided on a roll 220. The material is unwound and may optionally pass to perforators 230 that score the material to facilitate later removal of a header section 101. The material then passes over a folding board 245 (as is known in the art) to form the two side panels 31, 33. The folding board 245 may include a slitter (not shown), if e.g. the HFFS machine is operated in a different orientation.

In the embodiments of the invention illustrated in FIGS. 3-8, the first and second closure profiles 23, 25 are disengaged by the closure mechanism opening apparatus 70 prior to the closure mechanism material 50 being attached to the first and second side panels 31, 33. Alternately, the closure mechanism may be disengaged substantially simultaneously with the closure mechanism being attached to the side panels (i.e. disengagement and attachment as a single step), or disengagement may even occur after attachment to the side panels.

An example closure mechanism opening apparatus 70 is illustrated in FIGS. 4*a*-4*d*. The closure mechanism opening apparatus 70 comprises a rod 76 and a piston 72 that causes selective reciprocating movement of the rod 76. A preferred rod 76 and piston 72 are manufactured by DE-STA-CO Industries, 31791 Sherman Drive, Madison Heights, Mich. 48071, Model 816, made of steel and aluminum. The rod 76 and piston 72 are preferably mounted on a stand-off base 74.

Figure 4A:
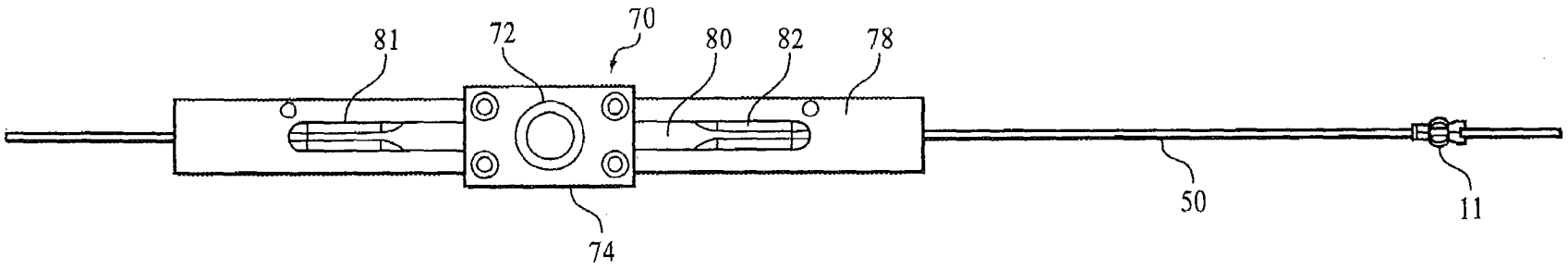
FIG. 4*a* is a top view of the device for opening a closure mechanism illustrated in FIG. 3.
Figure 4B:
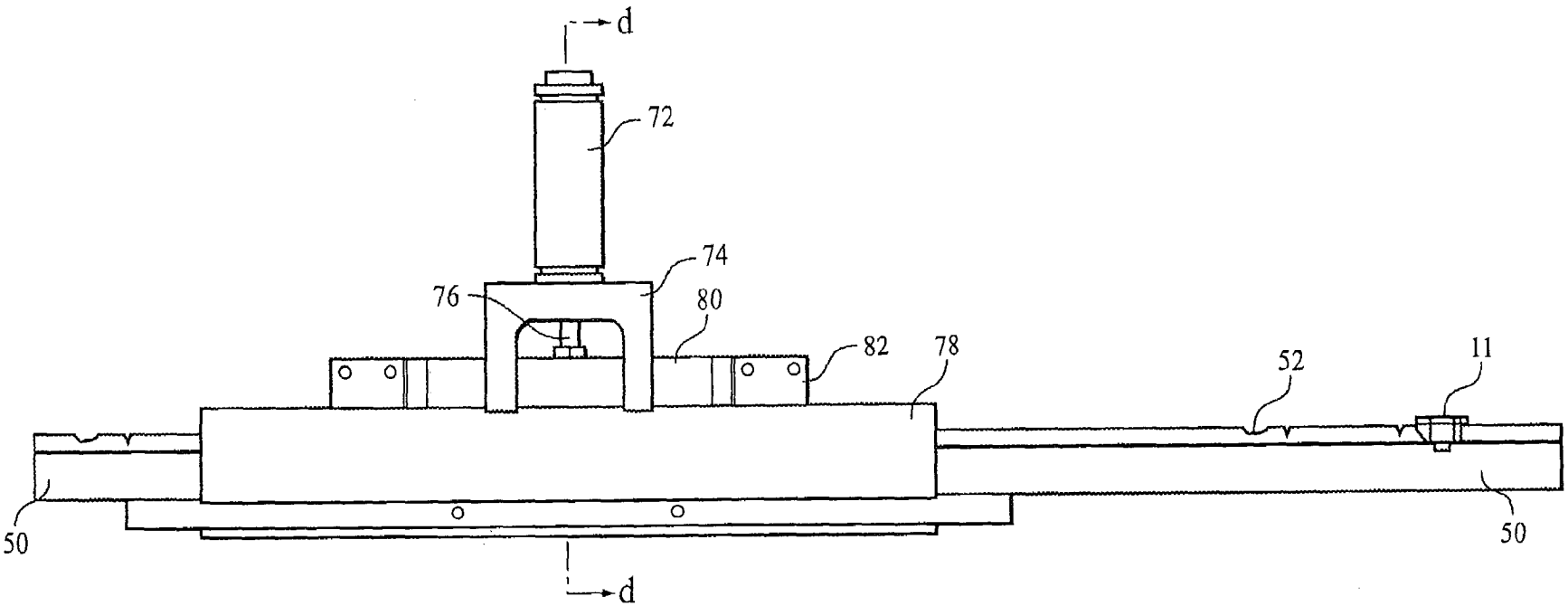
FIG. 4*b* is an elevated, side view of the device for opening a closure mechanism illustrated in FIG. 3.
Figure 4C:
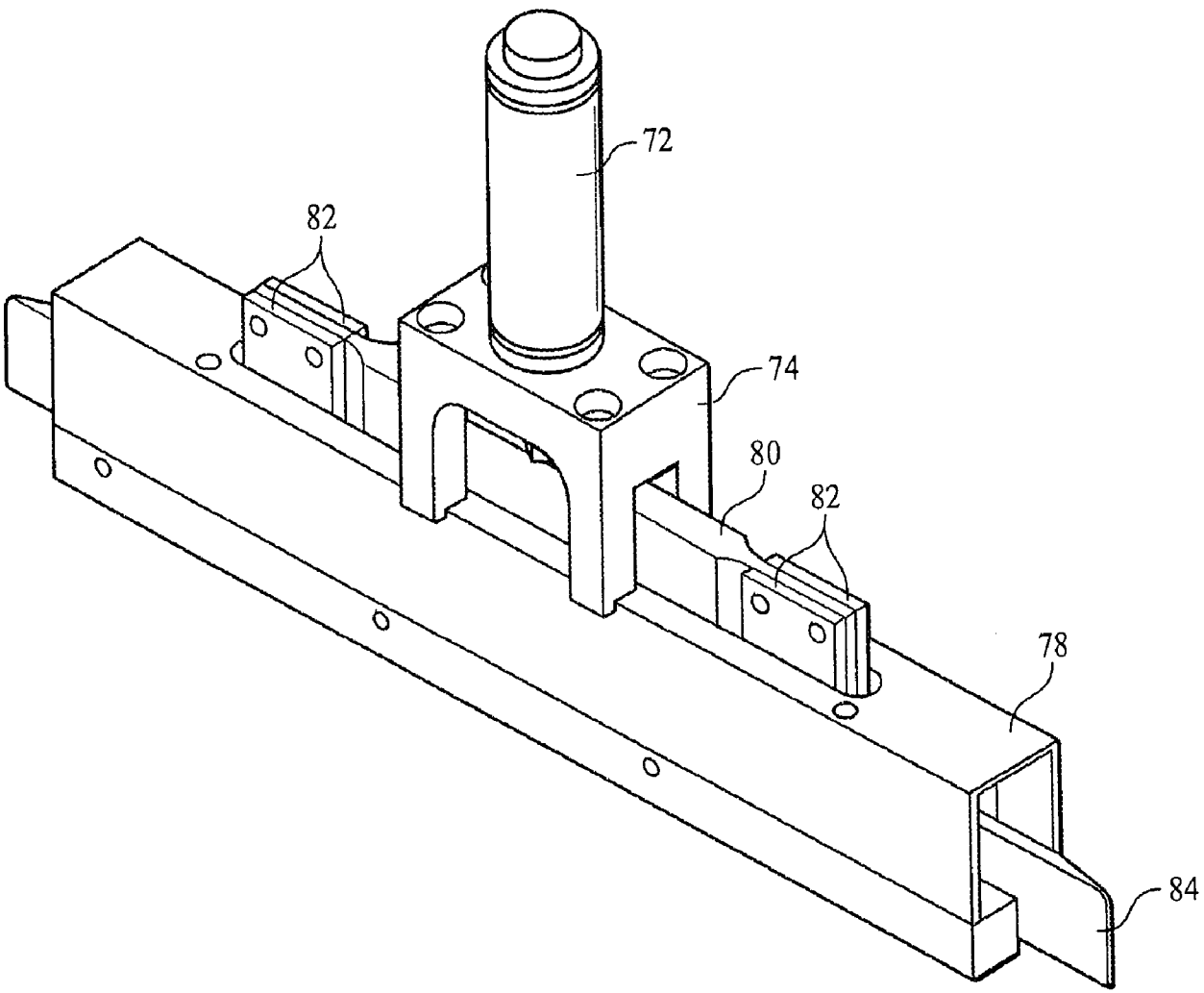
FIG. 4*c* is an alternate perspective view of the device for opening a closure mechanism illustrated in FIG. 3.
Figure 4D:
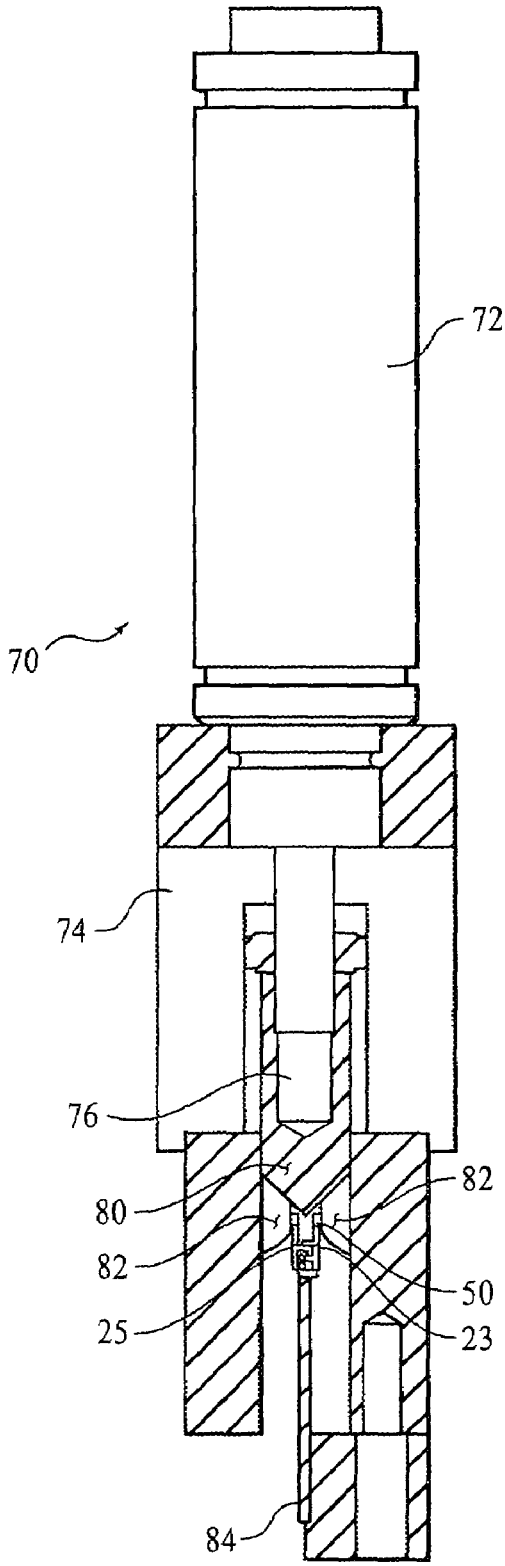
FIG. 4*d* is an cross-sectional view of the device for opening a closure mechanism illustrated in FIG. 3 taken along line 4*d*-4*d* (shown in FIG. 4*b*).

The rod 76 is operably connected to a wedge 80 such that as rod 76 moves, the wedge 80 moves. For example, if the piston is activated to move the rod in a reciprocating manner, the wedge would move in a similar manner. As best shown in FIG. 4*d*, the wedge 80 is preferably tapered along its bottom edge to allow it to penetrate between the closure profiles 23, 25. A set of guide members 82 are attached at both ends of the wedge 80. The guide members 82 act to align the closure mechanism material 50 as it passes through the closure mechanism opening apparatus 70. The guide members 82 are preferably designed and arranged to allow the closure mechanism material 50 to pass between them and align the closure mechanism material 50 beneath the wedge 80 or in similar proximity to the wedge, depending on the spatial orientation of apparatus 70. The guide members 82 are attached to the wedge 80 by any means known in the art, for example, by machined screws or by welding. Alternatively, the wedge 80 and guide members 82 may be formed integrally.

The closure mechanism opening apparatus 70 further comprises a three-sided guide channel 78. The guide channel 78 preferably has a support blade 84 attached to one of its sides as best seen in FIG. 4*d*. The stand-off base 74 is attached to the top of guide channel 78, which has an aperture 81 through its top side as shown in FIG. 4*a*. In this way, the selective reciprocating movement of the rod 76 causes the wedge 80 and guide members 82 to move up and down through the aperture 81 in the top of the guide channel 78.

Preferably, the closure mechanism opening device 70 further includes a support blade 84 that is designed and arranged such that when the closure mechanism material 50 passes through the guide channel 78, the closure mechanism material 50 straddles or rides on the blade 84, which supports the closure mechanism material 50. As stated previously, the blade 84 preferably assists in aligning the closure mechanism material 50 beneath the wedge 80.

In operation, a length of the closure mechanism material 50 that corresponds to the length of a resealable package 20 passes into the guide channel 78, on top of blade 84. The progress of the closure mechanism material 50 is stopped. The piston 72 is then actuated whereby the rod 76 is extended. This causes the wedge 80 and guide members 82 to be moved through the aperture 81 of the top of the guide channel 78. The guide members 82 are forced along the outside of the closure mechanism material 50, and the wedge 80 is disposed between the closure profiles 23, 25. As the wedge 80 is moved downward by the rod 76, the wedge 80 forces closure profiles 23, 25 to disengage along the length of the wedge 80. The wedge 80 is then withdrawn from the closure mechanism material 50. The opened closure mechanism material 50 is then advanced in an opened state for further processing, as is described below.

Figure 5:
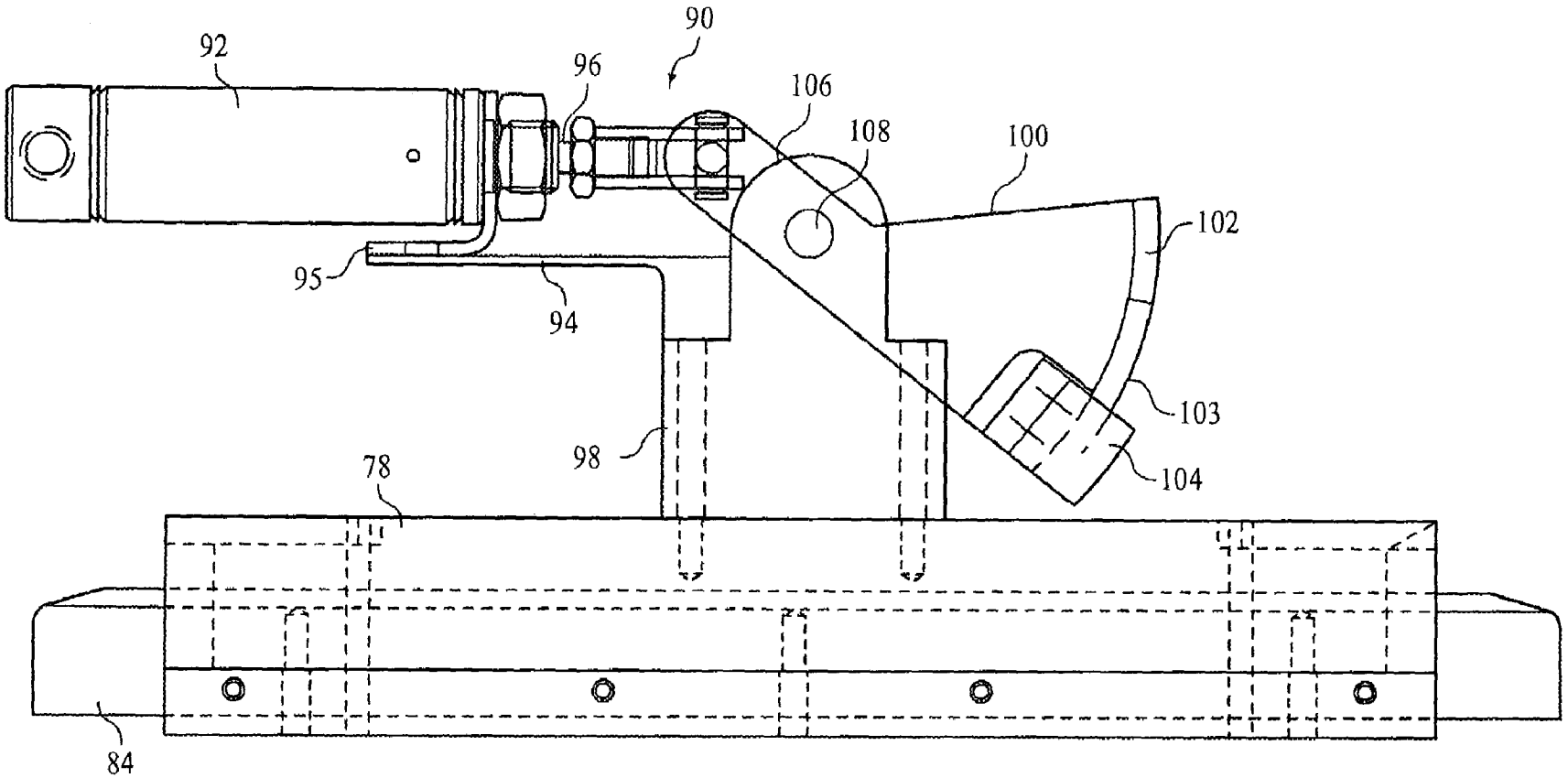
FIG. 5 is an elevated, side view of a alternate device for opening a closure mechanism used in accordance with an embodiment of the present invention.
Figure 6B:
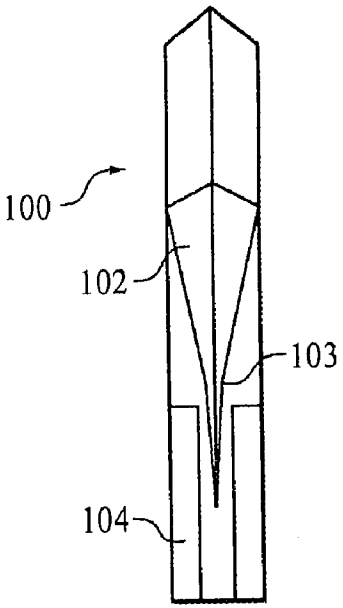
FIG. 6*b* is an elevated, end view of a wedge used as part of the device for opening a closure mechanism illustrated in FIG. 5.
Figure 6A:
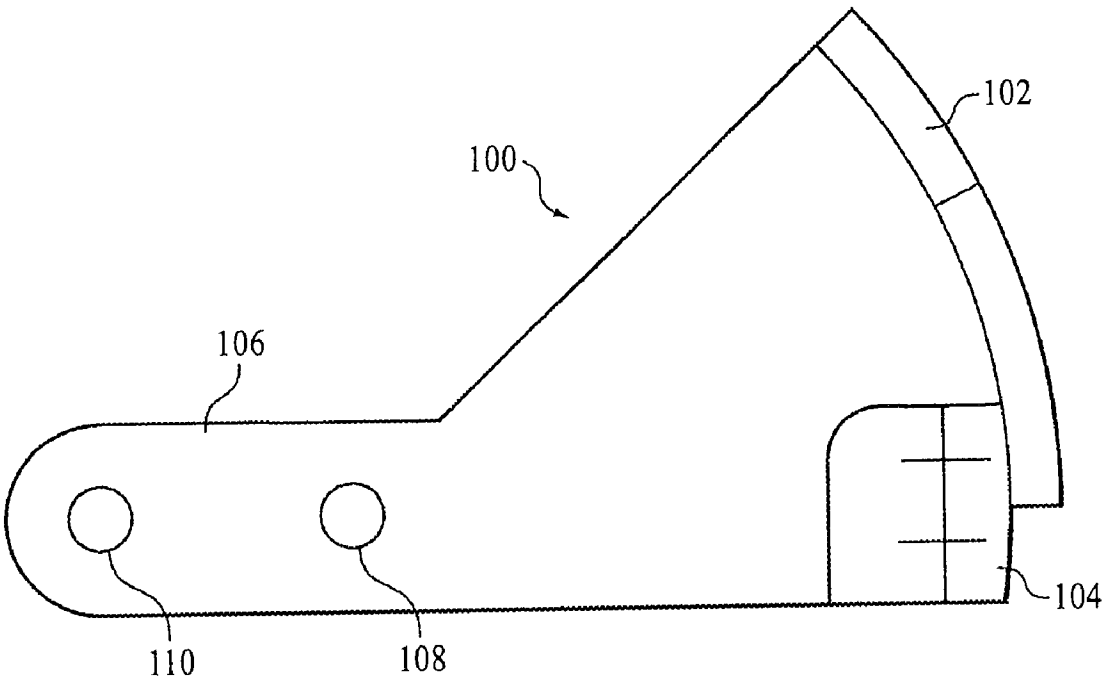
FIG. 6*a* is an elevated, side view of a wedge used as part of the device for opening a closure mechanism illustrated in FIG. 5.
Figure 6C:
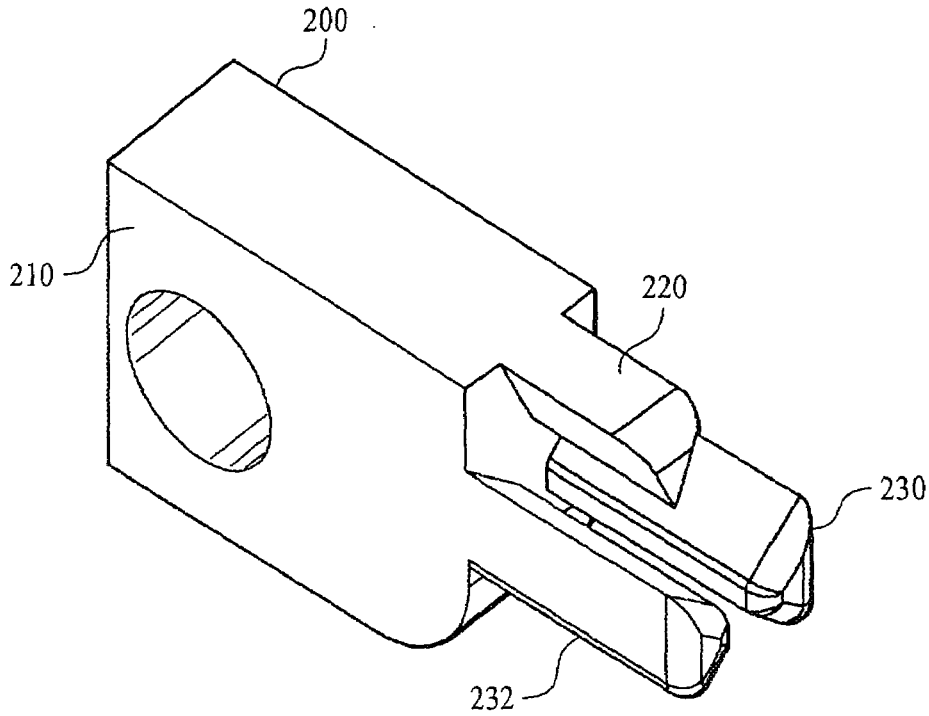
FIG. 6*c* is a perspective view with a cross-sectional view insert showing an alternate embodiment of a wedge that can be used in conjunction with the apparatus and methods described herein.
Figure 6D:
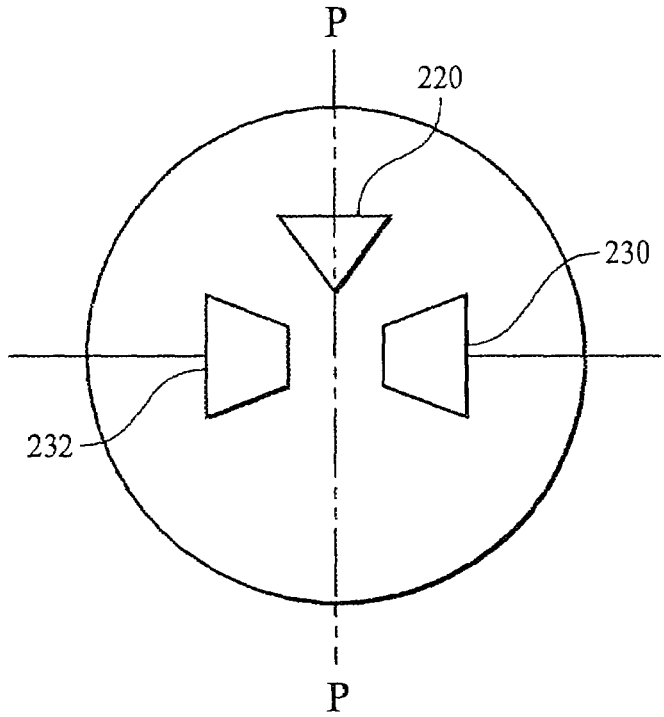
FIG. 6*d* is a schematic frontal view of the plow and guide legs of the wedge shown in FIG. 6*c*.
Figure 6E:
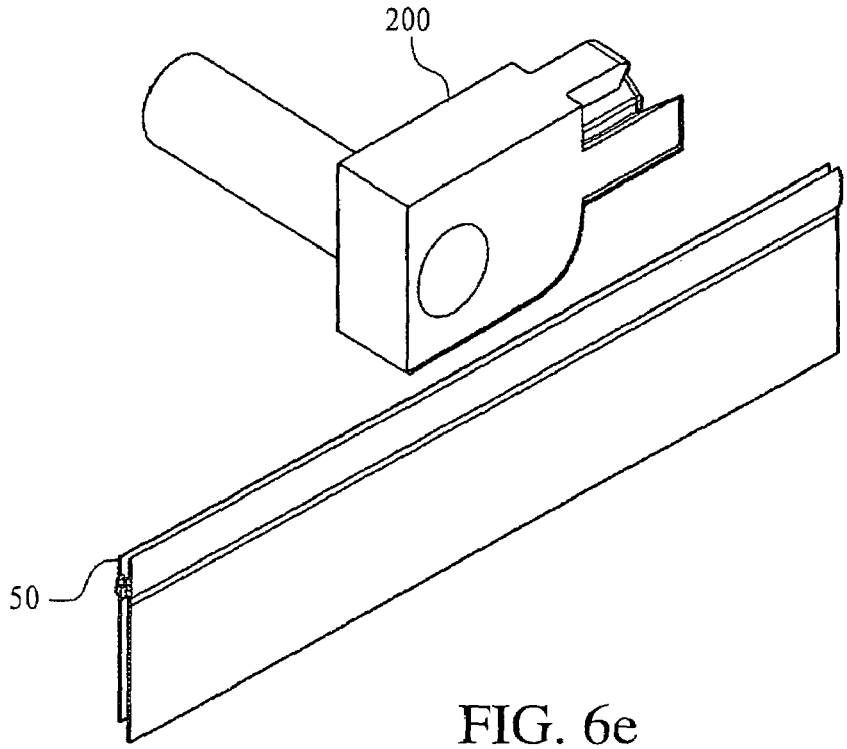
FIG. 6*e* is a perspective view showing the relational position between the wedge of FIG. 6*c* and a closure mechanism prior to opening the closure mechanism.
Figure 6F:
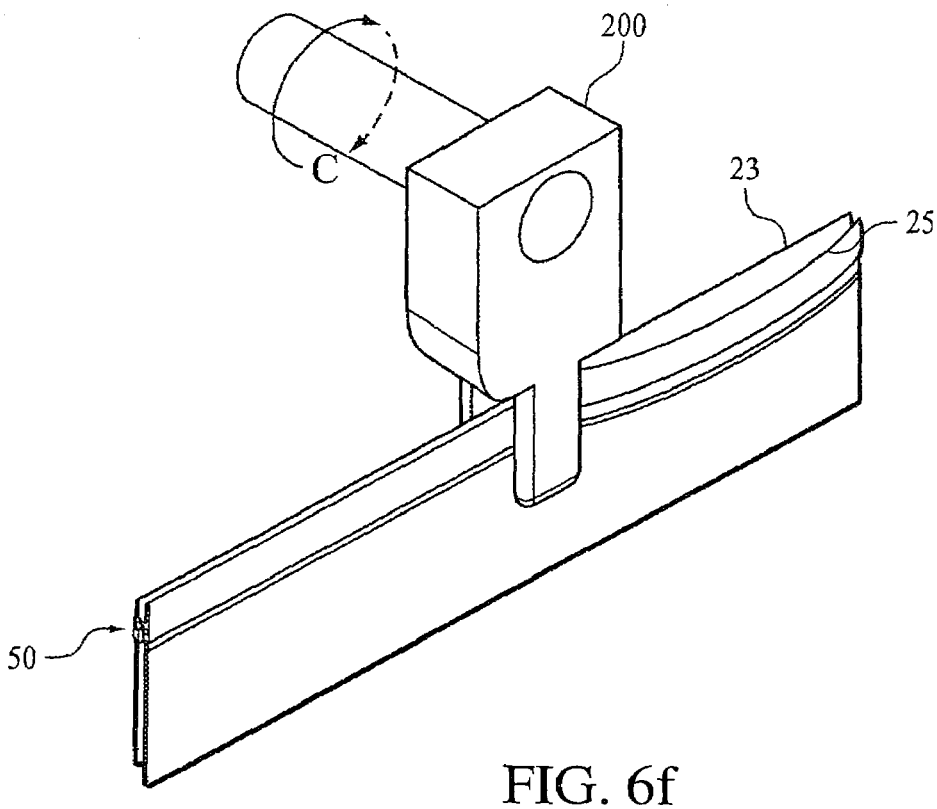
FIG. 6*f* is a perspective view showing the wedge of FIG. 6*c* passing into a closure mechanism to separate the closure profiles thereby opening the closure mechanism.
Figure 7:
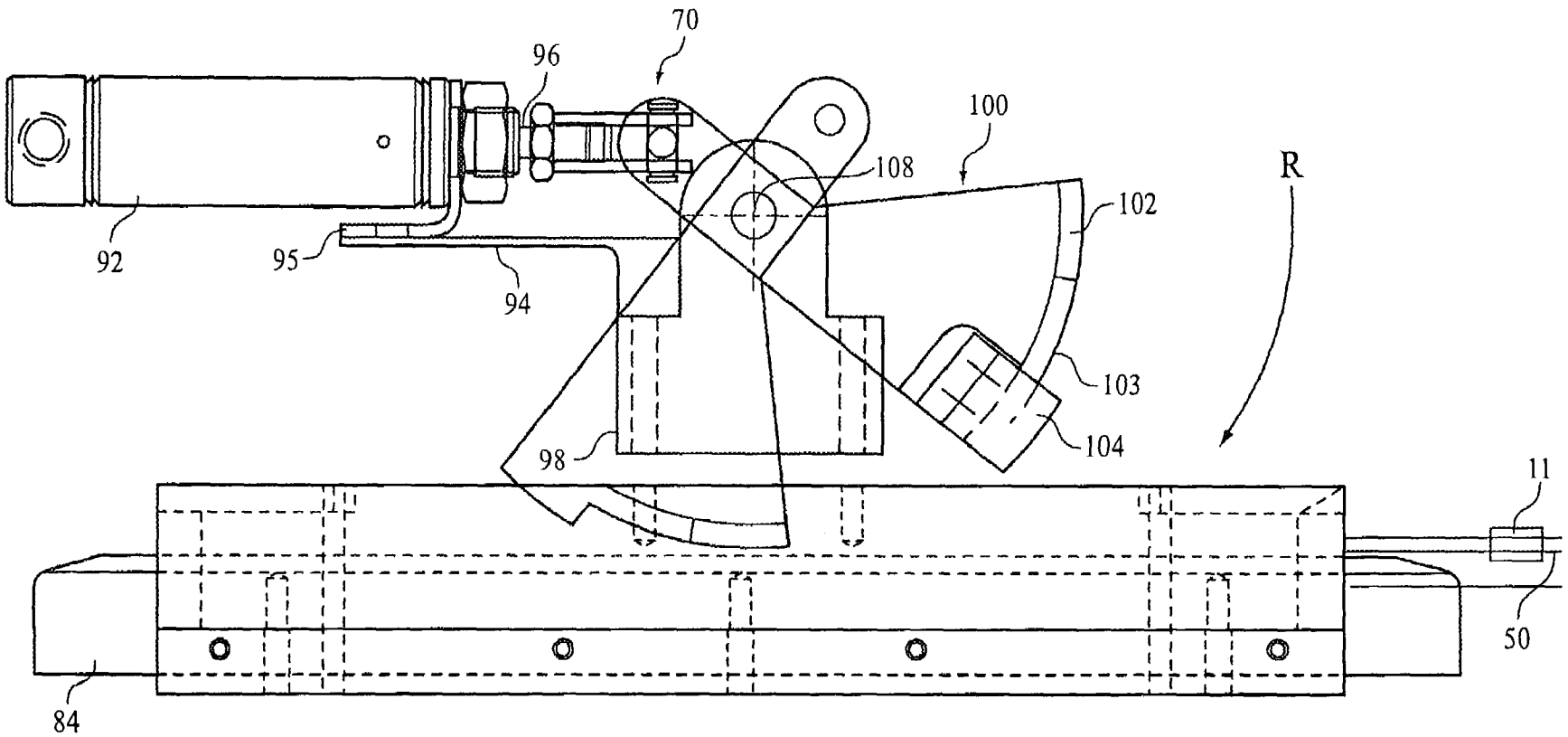
FIG. 7 is an elevated, side view of the device for opening a closure mechanism illustrated in FIG. 5, illustrating its operation.
Figure 8:
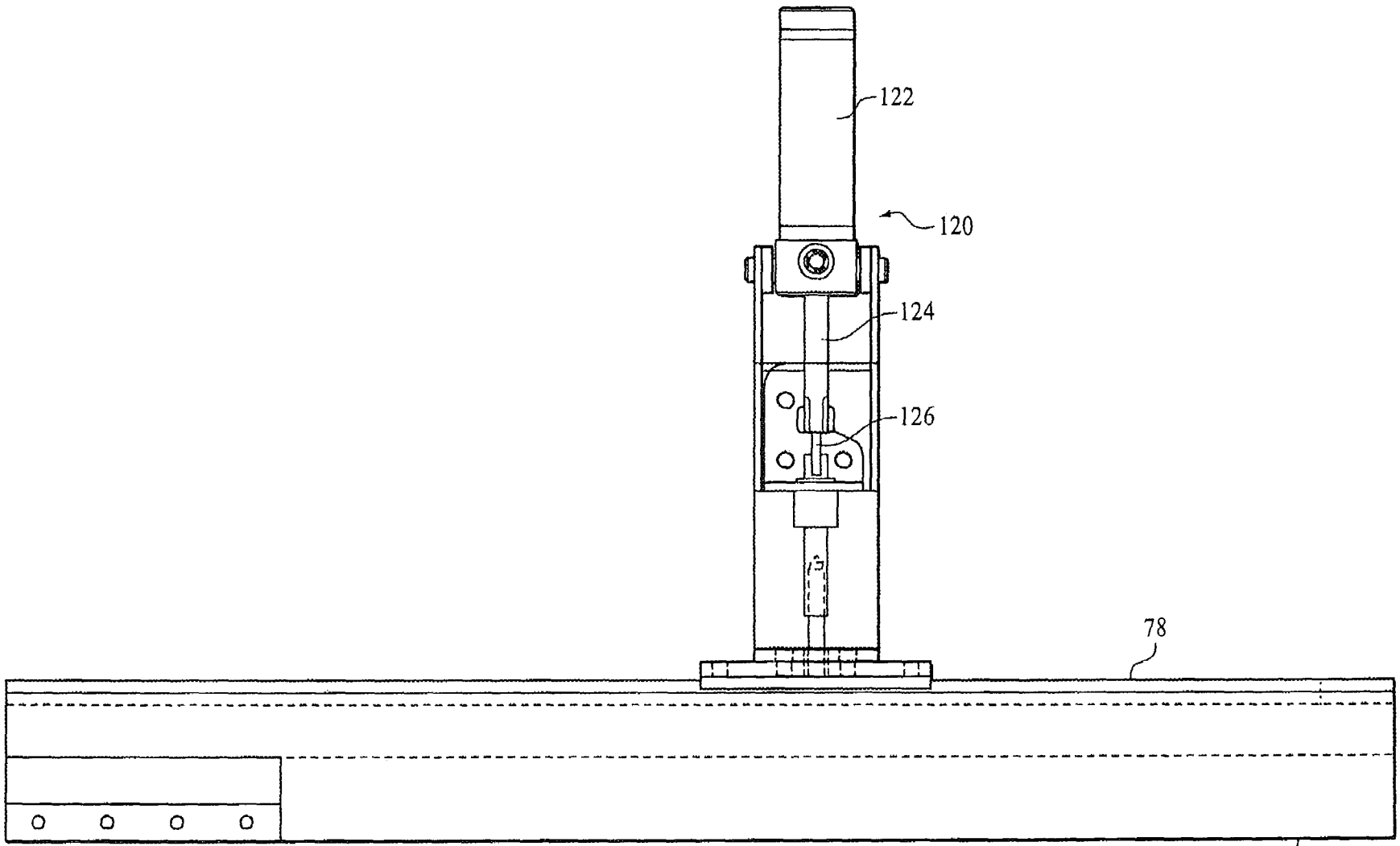
FIG. 8 is an elevated, side view of a alternate device for opening a closure mechanism used in accordance with an embodiment of the present invention.

An alternate example embodiment of a closure mechanism opening apparatus 70 is illustrated in FIGS. 5-7. In this embodiment, the guide channel 78 and the blade 84 are designed and function in a similar manner as in the embodiment illustrated in FIGS. 3-4*d*. The closure mechanism opening apparatus 70 further comprises a piston 92, a brace 98, and a wedge 100. The piston 92 includes a rod 96 that may move in a selective reciprocating manner. In this embodiment, the wedge 100 is generally shaped as a sector of a circle as shown in FIG. 6*a*. The wedge 100 includes an arm 106 that extends from the corner of the sector that would otherwise correspond with the center of the circle from which the sector would be taken. The arm 106 includes an opening 108 through which a pin or rod may be inserted in such a way as to allow the wedge 100 to rotate around such a pin or rod. The arm 106 is operably connected to the rod 96 such that when the rod 96 is extended from the piston 92, the wedge 100 rotates, preferably in the direction of the arrow R shown in FIG. 7. Likewise, when the rod 96 is withdrawn, the wedge 100 will rotate in a direction opposite that in which it rotates when the rod 96 is extended. The wedge 100 is preferably attached to the channel 78 by a brace 98. In the embodiment illustrated in FIG. 5, the brace 98 includes an opening that may be aligned with the opening 108 through the wedge 100. In this way, a pin or rod that is inserted through the opening 108 also serves to attach the wedge 100 to the brace 98. The brace 98 is also preferably attached to the piston 92 by way of brackets 94, 95.

As best shown in FIG. 6*b*, the curved edge 102 of the wedge 100 is tapered so that its leading edge 101 narrows to a point. The curved edge 102 also includes a pair of guide members 104 that are adjacent the leading edge 101. Similar to the embodiment described above, and as shown in FIG. 7, a length of the closure mechanism material 50 that corresponds to the length of a resealable package 20 passes into the guide channel 78, on top of blade 84. The progress of the closure mechanism material 50 is stopped. The piston 92 is then actuated whereby the rod 96 is extended. This causes the wedge 100, including guide members 104, to rotate through an aperture (not shown) in the top of the guide channel 78. The guide members 104 are forced along the outside of the closure mechanism material 50, and the curved edge 102 of the wedge 100 is disposed between a portion of the length of the closure profiles. As the wedge 100 rotates, the curved edge 102 of the wedge 100 forces closure profiles to disengage. After the closure profiles disengage, the wedge 100 rotates in the opposite direction, thereby withdrawing from the closure mechanism material 50. As one skilled in the art will recognize, an alternate embodiment to that illustrated in FIGS. 5-7 would be a blade designed to rotate in a complete 360° arc as it passes through the closure mechanism to disengage the closure profiles. The opened closure mechanism material 50 is then advanced in an opened state for further processing, as is described below.

FIGS. 6 *c-f* illustrate an alternate embodiment of a wedge 200 for use with the opening apparatus 70, for example, as shown in FIG. 5. As described above, the various methods of opening a closure mechanism with the embodiment illustrated in FIGS. 5-7 may include both reciprocal and rotational movement of the wedge (100, 200). For example, reciprocal movement is such that the wedge enters the closure mechanism in one direction (e.g. "R" in FIG. 7) and, after opening the closure mechanism, is removed from the closure mechanism in the opposite direction. Rotational movement of the wedge (100, 200) occurs by rotating the wedge (100, 200) with a controlled mechanical rotating device (not shown) such that the wedge moves in circular direction and passes into and out of the closure mechanism as the wedge (100, 200) scribes an arc at some aspect of circle "C" as depicted in FIG. 6*e-f*.

With reference to FIG. 6*c*, wedge 200 is shown consisting of a body 210, an opening plow 220 and guide legs 230, 232. As shown FIG. 6*d*, the plow 220 is preferably centered along a travel path "P" passing between guide legs 230, 232. This arrangement of the plow 220 with the guide legs 230, 232 facilitates the cooperation of these structures such that during operation the guide legs 230, 232 capture the closure mechanism and align the plow 220 to pass into the closure mechanism thereby opening the closure mechanism. It is preferable if the plow 220 has a tapered leading edge to facilitate its entry into the closed closure mechanism.

As further illustrated in FIGS. 6*d*-6*f*, the wedge 200 is preferably rotated into the closure mechanism material 50 to thereby separate (open) closure profiles 23, 25. After opening, the opened closure mechanism can be advanced for further processing (e.g. attachment, filling, etc.).

A further preferred embodiment of the invention is illustrated in FIGS. 8-10*b*. In this embodiment, the guide channel 78 and the blade 84 are designed and function in a similar manner as in the embodiments described above. In this embodiment, the channel 78 may also include an opening 79 (e.g. shown in FIGS. 10*a*-10*b*) through which a pair of sealing bars, 130, 132 may pass, as described below. In this embodiment, the closure mechanism opening apparatus 120 comprises a rod 124 and a piston 122 that causes selective reciprocating movement of the rod 124. A preferred rod 124 and piston 122 are manufactured again, by DE-STA-CO Industries.

In the embodiment illustrated in FIGS. 8-10*b*, the wedge 126 is generally cylindrical in shape, although one end may be tapered to facilitate opening of the closure mechanism material 50. The piston 122 and rod 124 are held in place above the guide channel 78 by brace 134.

Figure 9:
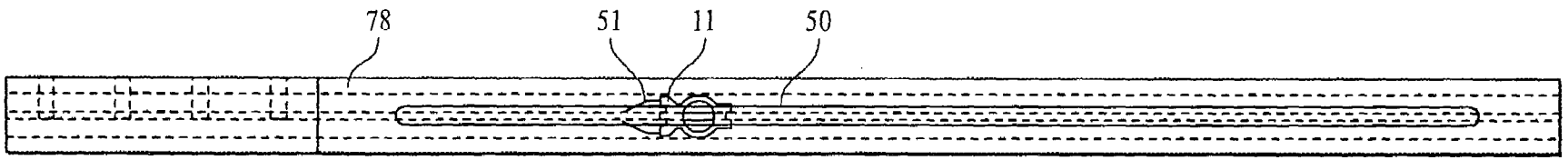
FIG. 9 is a top view of the device for opening a closure mechanism illustrated in FIG. 8.
Figure 10B:
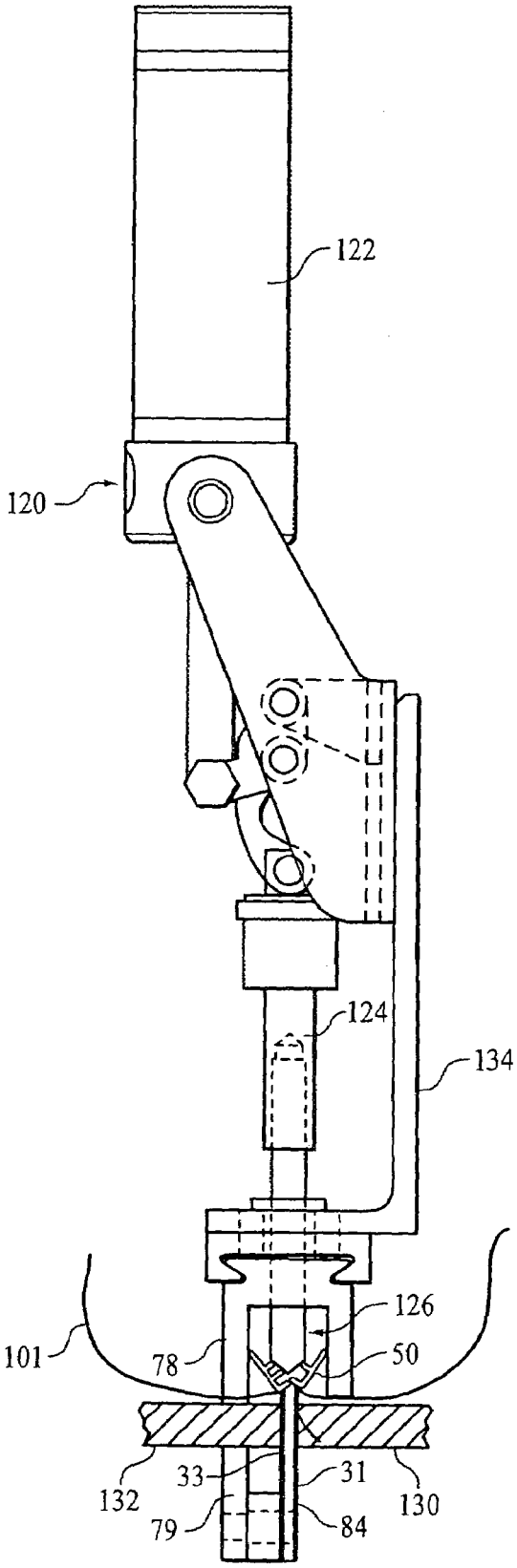
FIG. 10*b* is an end view of the device for opening a closure mechanism illustrated in FIG. 8, illustrating the use of sealing bars in accordance with an embodiment of the present invention.
Figure 10A:
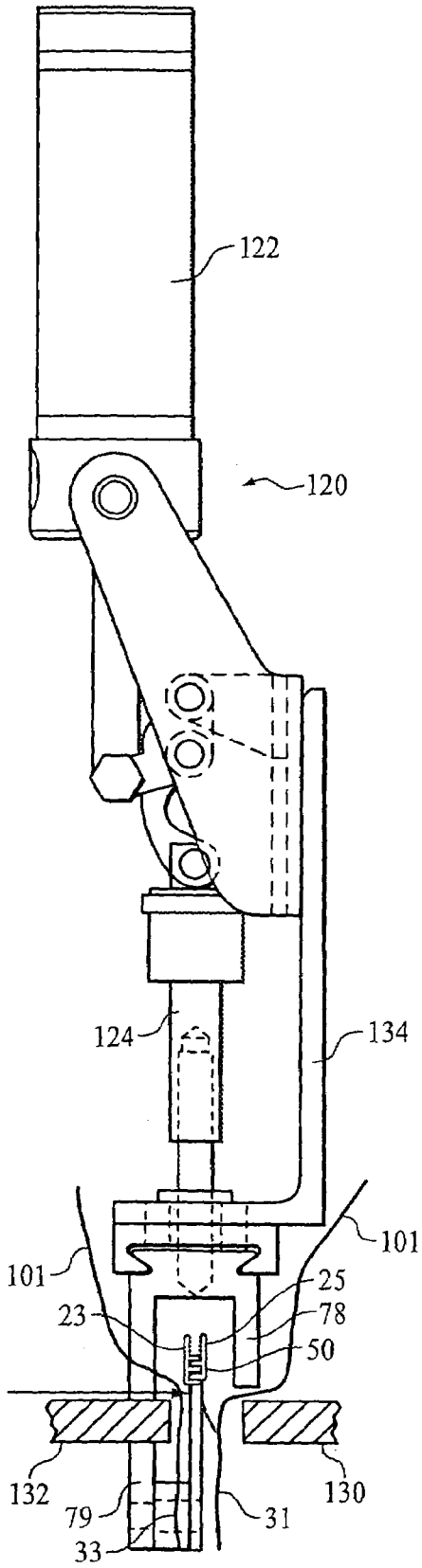
FIG. 10*a* is an end view of the device for opening a closure mechanism illustrated in FIG. 8.

This embodiment may take advantage of the fact that, when certain types of sliders 11 are attached to the closure mechanism material 50, a small opening 51 (as shown in FIG. 9) is created between the closure profiles 23, 25 immediately adjacent to the slider 11.

In operation, a length of the closure mechanism material 50 that preferably corresponds to the length of a resealable package 20 passes into the guide channel 78, on top of blade 84. The progress of the closure mechanism material 50 is stopped at a point when the opening 51 is directly beneath the wedge 126. The piston 122 is then actuated whereby the rod 124 is extended. This causes the wedge 126 to be moved through the top of the guide channel 78. The wedge 126 is disposed in the opening 51 between the closure profiles [23, 25].

Preferably, the guide channel 78 is aligned with sealing bars 130, 132 that are used to seal the side panels 31, 33 to the closure profiles 23, 25 such that the sealing bars 130, 132 may pass through the opening 79 in the guide channel 78. In this embodiment, it is preferred to have the sealing bars 130, 132 move together to seal the side panels 31, 33 to the closure profiles 23, 25 at substantially the same time that the wedge 126 is inserted into the opening 51. The sealing bars 130, 132 are then withdrawn from the guide channel 78. The closure mechanism material 50 is then advanced the length of one package 20 with the wedge 126 still inserted between the closure profiles 23, 25. As will be understood by one of ordinary skill in the art, this movement will cause the engaged portion of the closure mechanism material 50 to disengage. After the closure mechanism material 50 has been advanced, and thus disengaged along the length of one package 20, the wedge 126 is withdrawn from the closure mechanism material 50. The opened closure mechanism material 50 continues in an opened state for further processing, as is described below.

In the embodiments illustrated in FIGS. 3-7, the closure mechanism material 50 is opened, but not yet sealed to the side panels 31, 33. In the embodiment illustrated in FIGS. 8-10*b*, the closure mechanism material 50 is positioned between the side panels 31, 33. The side panels 31, 33 are then heat sealed to the closure profiles 23, 25 by sealing bars 130, 132. The various embodiments of this invention contemplate that opening of the closure mechanism 41 and sealing of the closure profiles 23, 25 to the side panels 31, 33 can occur either sequentially (e.g. opening followed by sealing or sealing followed by opening) or simultaneously (i.e. opening and sealing at the same station and substantially at the same time).

Figure 11B:
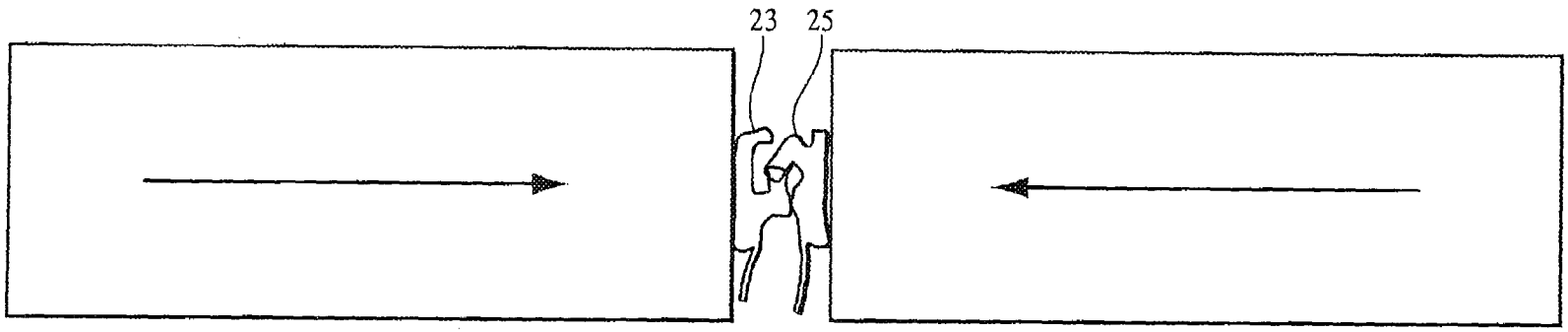
FIGS. 11*a-c* are cross-sectional views of an opening device and method that employ a perpendicular external force to open a closure mechanism.
Figure 11A:
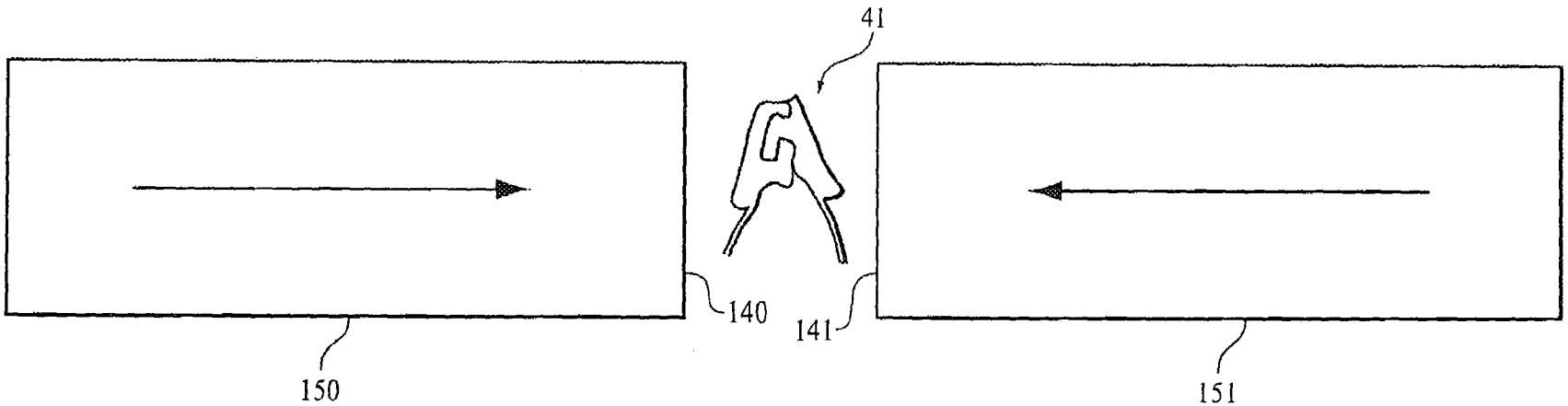
Figure 11C:
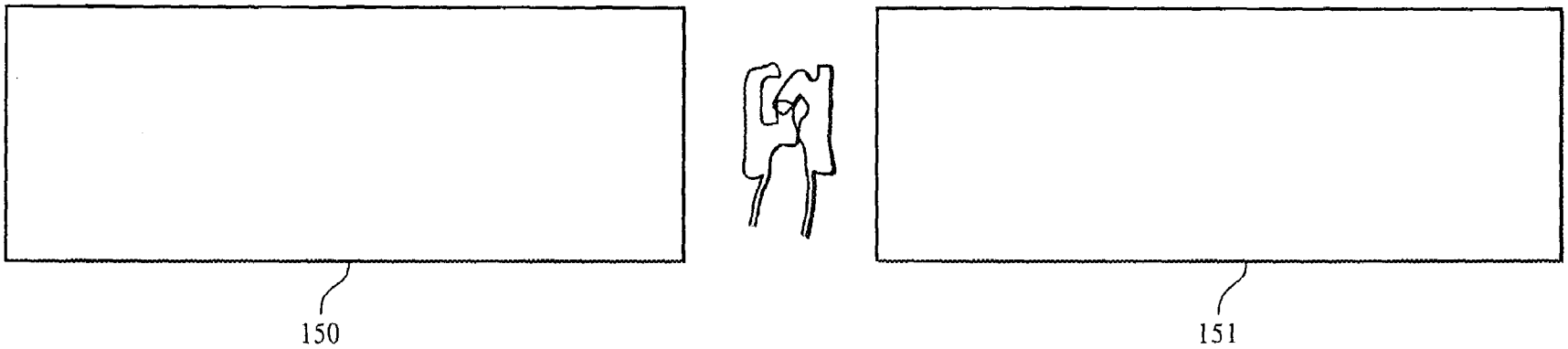

Two additional embodiments are schematically illustrated in FIGS. 11-12, each of which incorporates a force that is external to the closure mechanism 41 to open the closure profiles 23, 25. With reference to FIG. 11*a*, a cross-sectional view of an alternate closure mechanism 41 is shown in a closed or engaged position. The engaged mechanism 41 is positioned between two opposing flat surfaces 140, 141, on moveable wedges 150, 151. Upon activating the opening apparatus 70 illustrated in FIG. 11*a*, the moveable wedges 150, 151 move towards each other, as best shown in FIG. 11*b*, with sufficient force to "pinch" the closure profiles 23, 25 of closure mechanism 41 into an open position. The pinching occurs as surfaces 140, 141 come in contact with closure profiles 23, 25. Following this "pinch-open" action, the wedges 150, 151 move apart, as shown in FIG. 11*c*, and reset for admission of the next closure mechanism to be opened.

One of skill in the art will recognize many variations of practicing the invention illustrated in FIGS. 11*a*-11*c*. For example, one of the moveable wedges (150) could be replaced with an immovable surface such that only one moveable wedge (151) would have to move and pinch the closure mechanism against the immovable surface to open these closure profiles.

Figure 12A:
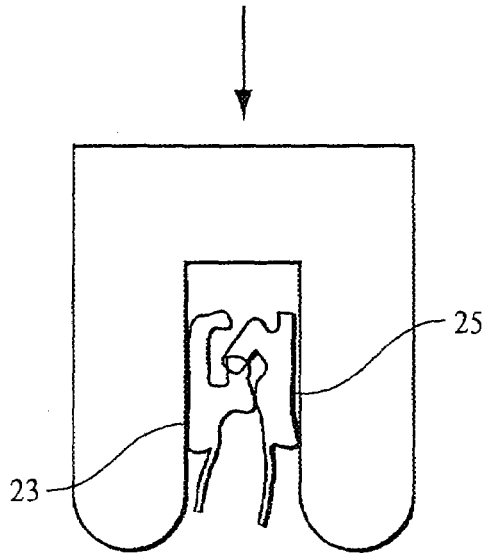
FIG. 12 is a cross-sectional view of an opening device and method that use a channel wedge to open a closure mechanism.
Figure 12B:
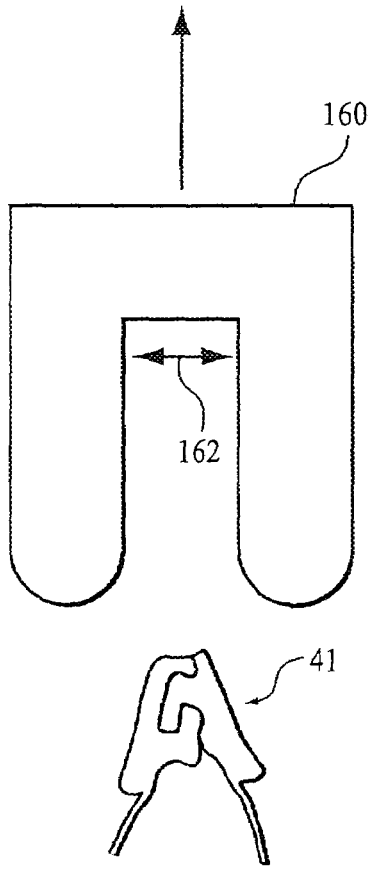

A further embodiment utilizing a force external to the closure mechanism to open the closure profiles is illustrated in cross-section in FIGS. 12*a*-*b*. In this embodiment, a channel wedge 160 is placed over closure profile 50 (FIG. 12*a*), such that said action of placement forces open the closure profiles 23, 25 (FIG. 12*b*). Preferably, the interior dimension 162 of the channel wedge 160 is proportioned appropriately to accomplish the opening of the closure profiles 23, 25 without disrupting the integrity of the package (not shown).

It is contemplated that the channel wedge embodiment operates in a substantially similar manner the method as previously described for the wedge illustrated in FIGS. 4*a*-4*d*. The main difference between these distinct embodiments is that the closure mechanism illustrated in FIGS. 4*a*-4*d* lends itself to being split-open by inserting a wedge between the closure profiles, while the closure mechanism of FIG. 12 is opened by a force applied externally to the closure profiles.

Referring back to FIG. 2, after opening the closure mechanism in accordance with the invention disclosed herein, the continuous line of packages continues to sealing bars 112 that seal the sides 31, 33 of the package 20. The continuous line of packages then pass under hopper 114 that contains the product to be placed in package 20. As the packages pass under the hopper 114, product 241 passes through the mouth of the header section 101 and into the interior of the package 20. In certain embodiments, the mouth of the header section 101 is then sealed by sealing bars 116 to form a tamper-evident structure. Finally, the continuous line of packages is separated into individual packages by cutting knife 118.

While specific embodiments and methods for practicing this invention have been described in detail, those skilled in the art will recognize various manifestations and details that could be developed in light of the overall teachings herein. Accordingly, the particular mechanisms disclosed are meant to be illustrative only and not to limit the scope of the invention which is to be given the full breadth of the following claims and any and all embodiments thereof.

What is claimed is:

1. In a process for making a resealable package, a method of disengaging at least a portion of a pair of engaged resealable closure profiles comprising:

(a) optionally attaching a slider to said resealable closure profiles; and (b) actuating a movable wedge and thereby inserting said wedge into at least a portion of said engaged resealable closure profiles, wherein said wedge is a portion of an apparatus comprising:

(i) a piston and a rod, said rod being in operable connection with the wedge;

(ii) a guide channel aligned to guide the closure profiles in proximity with the wedge;

(iii) a support blade in planer alignment with said wedge such that the closure profiles are supported by the blade and aligned in proximity with the wedge; and (iv) means for activating said piston such that the piston moves the rod which functions to insert the wedge into the closure profiles to thereby open the closure profiles.

2. The method of claim 1 further comprising a step of attaching a slider to the closure profiles contemporaneously with said disengagement.

3. The method of claim 1 wherein the shape of the wedge is selected from the group consisting of substantially circular wedges and substantially linear wedges.

4. The method of claim 1 wherein said wedge undergoes substantially linear motion to be inserted into said engaged profiles.

5. The method of claim 1 wherein the wedge undergoes substantially linear motion to be inserted into said engaged profiles.

6. The method of claim 1 wherein the wedge undergoes substantially arcuate motion to be inserted into said engaged profiles.

7. The method of claim 1 wherein the wedge undergoes substantially arcuate motion to be inserted into said engaged profiles.

8. The method of claim 1 wherein said wedge comprises guide members to align the closure profiles in proximity with the wedge.

9. The method of claim 1 wherein the wedge has a length substantially equal to the width of the opening of the resealable package being manufactured.

10. The method of claim 1 wherein the wedge has a length less than the width of the resealable package being manufactured and following disengagement of the stationary closure profiles by inserting the wedge, the engaged portion of the profile is disengaged by differential motion between the inserted wedge and the profile along the length of the engaged portion of the profile.

11. The method of claim 1 wherein said wedge comprises a channel wedge.

12. The method of claim 1 wherein said process for making a resealable package comprises attaching package side panels to said resealable closure profiles contemporaneously with disengaging said closure profiles by inserting thereinto said wedge.

13. The method of claim 1 wherein said process for making a resealable package comprises attaching package side panels to said resealable closure profiles prior to disengaging said closure profiles by inserting thereinto said wedge.

14. The method of claim 13 wherein said process for making a resealable package further comprises forming a complete package and inserting thereinto a fill through said disengaged resealable closure profiles.

15. The method of claim 1 wherein said process for making a resealable package further comprises attaching a slider to said resealable closure profiles prior to inserting said wedge into at least the portion of said engaged profiles.

* * * * *